US007161338B2

(12) United States Patent
Jiang et al.

(10) Patent No.: US 7,161,338 B2
(45) Date of Patent: Jan. 9, 2007

(54) LINEAR VOLTAGE REGULATOR WITH AN ADJUSTABLE SHUNT REGULATOR-SUBCIRCUIT

(75) Inventors: Wu Jiang, Shenzhen (CN); Yun Li, Shenzhen (CN)

(73) Assignees: Hong Fu Jin Precision Industry (Sbenzhen) Co., Ltd. (CN); Hon Hai Precision Industry Co., Ltd. (TW)

( * ) Notice: Subject to any disclaimer, the term of this patent is extended or adjusted under 35 U.S.C. 154(b) by 0 days.

(21) Appl. No.: 11/284,872

(22) Filed: Nov. 21, 2005

(65) Prior Publication Data

US 2006/0108991 A1 May 25, 2006

(30) Foreign Application Priority Data

Nov. 20, 2004 (CN) ..... 2004 2 0956981

(51) Int. Cl.
*G05F 1/40* (2006.01)
*G05F 1/44* (2006.01)
*G05F 1/56* (2006.01)

(52) U.S. Cl. ..... 323/272; 323/273; 323/274

(58) Field of Classification Search ..... 323/273, 323/274, 275, 266
See application file for complete search history.

(56) References Cited

U.S. PATENT DOCUMENTS 4,543,522 A * 9/1985 Moreau ..... 323/303
4,560,918 A * 12/1985 Callen ..... 323/273
5,319,303 A * 6/1994 Yamada ..... 323/313
6,084,387 A * 7/2000 Kaneko et al. ..... 323/281
6,249,112 B1 * 6/2001 Khouri et al. ..... 323/282
6,265,856 B1 * 7/2001 Cali' et al. ..... 323/273
6,377,033 B1 4/2002 Hsu
6,404,174 B1 * 6/2002 Boudreaux et al. ..... 323/273
6,441,594 B1 * 8/2002 Connell et al. ..... 323/274

* cited by examiner

*Primary Examiner*—Bao Q. Vu
(74) *Attorney, Agent, or Firm*—Morris Manning & Martin LLP; Tim Tingkang Xia, Esq.

(57) ABSTRACT

A linear voltage regulator is provided for providing an output voltage to a load. In a preferred embodiment, the linear voltage regulator comprises: an operational amplifier receiving a regulated voltage, and a first voltage reference, and providing a driving voltage; a first regulating transistor driven by the driving voltage, the regulating transistor receiving a system voltage, and providing the regulated voltage; a second regulating transistor receiving the regulated voltage, and providing an output voltage, the second regulating transistor controlled by a controlling voltage; a resistive voltage divider receiving the output voltage, and providing a second voltage reference; and a three-terminal adjustable shunt regulator receiving the second voltage reference, and providing the controlling voltage to the second regulating transistor. Because the first regulating transistor pulls down the system voltage to the regulated voltage, the operating voltage of the second regulating transistor is lower than that of a typical linear voltage regulator, therefore the linear voltage regulator can provide a high-power to the load.

14 Claims, 3 Drawing Sheets

LINEAR VOLTAGE REGULATOR WITH AN ADJUSTABLE SHUNT REGULATOR-SUBCIRCUIT

CROSS-REFERENCE TO RELATED APPLICATION

Relevant subject matter is disclosed in two co-pending U.S. patent applications entitled "LINEARLY REGULATED POWER SUPPLY" and "LINEAR VOLTAGE REGULATOR", which are assigned to the same assignee with this application.

BACKGROUND

1. Field of the Invention

The present invention relates to voltage regulators, and particularly to a linear voltage regulator for providing a high-power to a load mounted on a motherboard.

2. General Background

Linear voltage regulators are widely used to supply power to electronic devices, such as to a load on a motherboard of a computer. Such linear voltage regulators are available in a wide variety of configurations for many different applications.

A typical linear voltage regulator includes a resistive voltage divider, a three-terminal adjustable shunt regulator, and a regulating transistor. The resistive voltage divider receives an output voltage, and provides a voltage reference to the three-terminal adjustable shunt regulator. The three-terminal adjustable shunt regulator receives the voltage reference, and provides a controlling voltage to the regulating transistor. The regulating transistor controlled by the controlling voltage receives a system voltage, and provides the output voltage to a load.

When the output voltage suddenly becomes higher, the controlling voltage becomes lower correspondingly. Then a current through the regulating transistor reduces. Therefore the output voltage drops to a same level as before the sudden increase thereof. Contrarily, when the output voltage suddenly becomes lower, the controlling voltage becomes higher correspondingly. Then the current through the regulating transistor increases. Therefore the output voltage climbs to a same level as before the sudden decrease thereof.

However, An operating voltage of the regulating transistor is in inverse ratio to an operating current of the regulating transistor when a power of the regulating transistor is invariable. So the higher the operating voltage is, the lower the current is, when a power of the regulating transistor is invariable. Therefore the typical linear voltage regulator cannot provide a high-power to the load.

What is needed, therefore, is a linear voltage regulator which is able to provide a high-power to a load.

SUMMARY

A linear voltage regulator is provided for providing an output voltage to a load. In a preferred embodiment, the linear voltage regulator includes: an operational amplifier receiving a regulated voltage, and a first voltage reference, and providing a driving voltage; a first regulating transistor driven by the driving voltage, the regulating transistor receiving a system voltage, and providing the regulated voltage; a second regulating transistor receiving the regulated voltage, and providing an output voltage, the second regulating transistor controlled by a controlling voltage; a resistive voltage divider receiving the output voltage, and providing a second voltage reference; and a three-terminal adjustable shunt regulator receiving the second voltage reference, and providing the controlling voltage to the second regulating transistor. The first regulating transistor pulls down the system voltage to the regulated voltage V1. An operating voltage of the second regulating transistor equals to a difference of the regulated voltage V1 and the output voltage V0 (e.g. V1–V0). So the operating voltage is lower than a difference of the system voltage V2 and the output voltage V0 (e.g. V2–V0). The operating voltage of the second regulating transistor is in inverse ratio to an operating current of the second regulating transistor when a power of the second regulating transistor is invariable. So the higher the operating voltage is, the lower the current is, when a power of the regulating transistor is invariable. Now the operating voltage is lower, therefore the linear voltage regulator can provide a higher current to the load, that is, the linear voltage regulator can provide a high-power to the load.

The linear voltage regulator is capable of providing a high-power to the load.

Other advantages and novel features will become more apparent from the following detailed description of preferred embodiments when taken in conjunction with the accompanying drawings, in which:

DETAILED DESCRIPTION OF THE EMBODIMENTS

Figure 1:
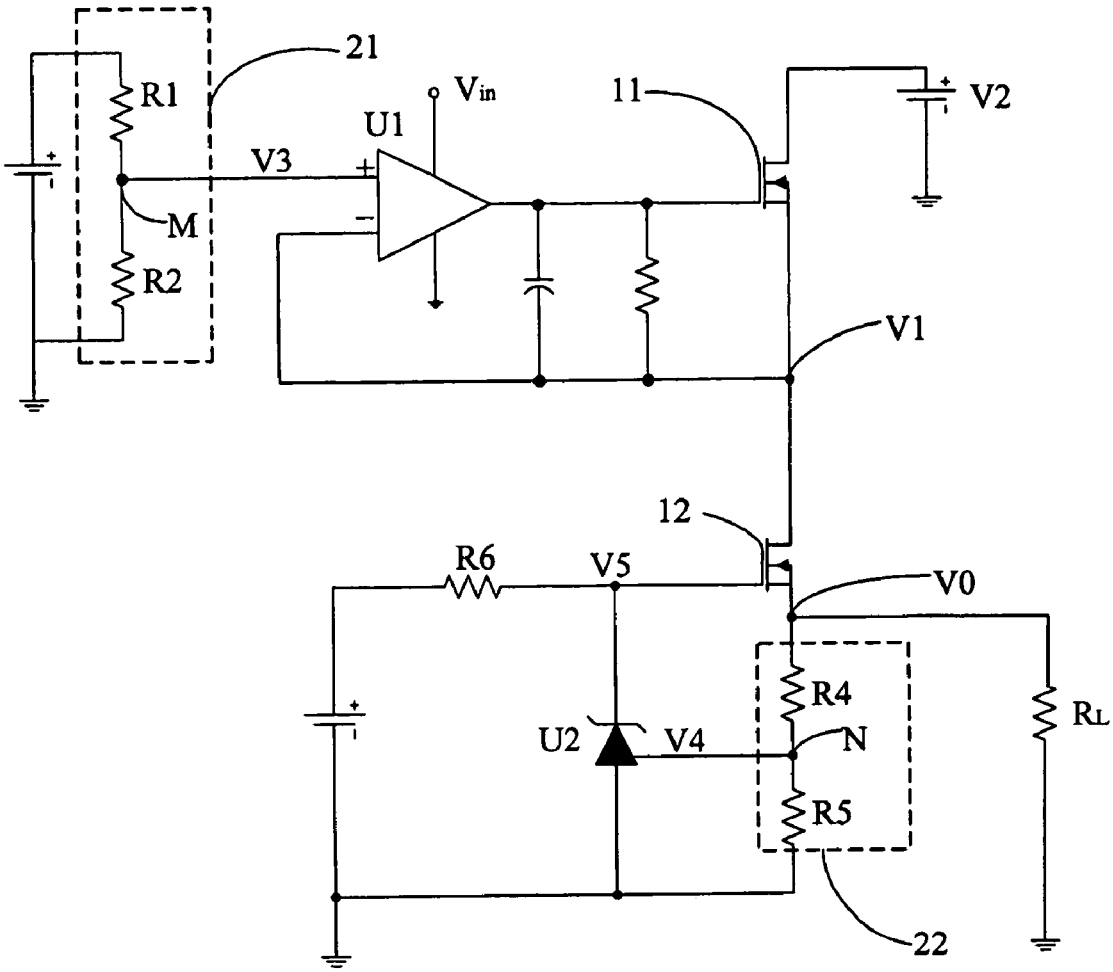
FIG. 1 is a circuit diagram of a linear voltage regulator of a preferred embodiment of the present invention.

Referring to FIG. 1, in a preferred embodiment of the present invention, a linear voltage regulator includes a first regulating transistor 11, an operational amplifier U1, a first resistive voltage divider 21, a second regulating transistor 12, a second resistive voltage divider 22, a three-terminal adjustable shunt regulator U2, and a current-limiting resistor R6.

The first resistive voltage divider 21 includes resistors R1 and R2 connected to each other in series between a system voltage and a ground. A first node M between the resistors R1 and R2 provides a first voltage reference V3 to the operational amplifier U1. The first regulating transistor 11 is an N-channel metal-oxide-semiconductor field-effect transistor (MOSFET). The first regulating transistor 11 includes a gate as a controlling end, a drain as an input end, and a source as an output end. The first operational amplifier U1 has a non-inverting input terminal, an inverting input terminal, and an output terminal. The drain of the first regulating transistor 11 receives a system voltage V2. The source of the first regulating transistor 11 provides a regulated voltage V1. The non-inverting input terminal is connected to the first node M for receiving the first voltage reference V3. The inverting input terminal receives the regulated voltage V1. The output terminal is connected to the gate of the first regulating transistor 11 for driving the first regulating transistor 11.

The second regulating transistor 12 includes a gate as a controlling pole, a drain as an input pole, and a source as an output pole. The gate of the second regulating transistor 12 receives the regulated voltage V1. The source of the second regulating transistor 12 provides an output voltage V0. The second resistive voltage divider 22 includes resistors R4 and R5 connected to each other in series between the output voltage V0 and a ground. A second node N between the resistors R4 and R5 provides a second voltage reference V4 to the three-terminal adjustable shunt regulator U2. The three-terminal adjustable regulator includes an anode terminal, a cathode terminal, and a reference terminal. The reference terminal is connected to the second node N for receiving the second voltage reference V4. The cathode terminal is coupled to a system voltage via a current-limiting resistor R6, and connected to the gate of the second regulating transistor 12 for providing a controlling voltage V5 to the second regulating transistor 12. The anode terminal is grounded.

When the regulated voltage V1 suddenly increases, the controlling voltage provided by the operational amplifier U1 decreases correspondingly. As a result, the regulated voltage V1 provided by the first regulating transistor 11 drops to a same level as before the sudden increase thereof. Contrarily, when the regulated voltage V1 suddenly decreases, the controlling voltage provided by the operational amplifier U1 is increases correspondingly. As a result, the regulated voltage V1 provided by the first regulating transistor 11 climbs to a same level as before the sudden increase thereof. Therefore the regulated voltage V1 is steady.

In the same way, when the output voltage V0 suddenly increases, the voltage reference V4 increases correspondingly. Then the controlling voltage V5 decreases. As a result, the output voltage V0 drops to a same level as before the sudden increase thereof. Contrarily, when the output voltage V0 suddenly decreases, the voltage reference V4 decreases correspondingly. Then the controlling voltage V5 increases. As a result, the output voltage V0 climbs to a same level as before the sudden increase thereof. Therefore the output voltage V0 is steady.

Figure 2:
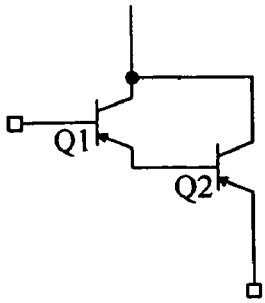
FIGS. 2–6 shows various embodiments of the pass element comprising two or three bipolar transistors.

In the embodiment as shown in FIG. 2, the first regulating transistor 11 or the second regulating transistor 12 can be replaced by a PNP bipolar transistor Q1, and a PNP bipolar transistor Q2. An emitter of the PNP bipolar transistor Q1 is connected to a base of the PNP bipolar transistor Q2. Collectors of the PNP bipolar transistor Q1 and the PNP bipolar transistor Q2 are connected to each other as the input terminal. A base of the PNP bipolar transistor Q5 is the controlling terminal. An emitter of the PNP bipolar transistor Q6 is the output terminal.

Figure 3:
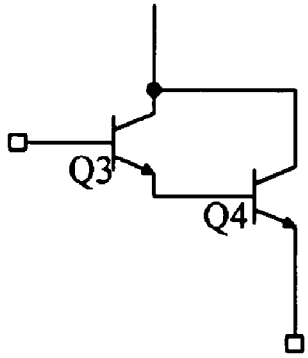

In the embodiment as shown in FIG. 3, the first regulating transistor 11 or the second regulating transistor 12 can be replaced by an NPN bipolar transistor Q3, and an NPN bipolar transistor Q4. An emitter of the NPN bipolar transistor Q3 is connected to a base of the NPN bipolar transistor Q4. Collectors of the NPN bipolar transistor Q3 and NPN bipolar transistor Q8 are connected to each other as the input terminal. A base of the NPN bipolar transistor Q3 is the controlling terminal. An emitter of the NPN bipolar transistor Q4 is the output terminal.

Figure 4:
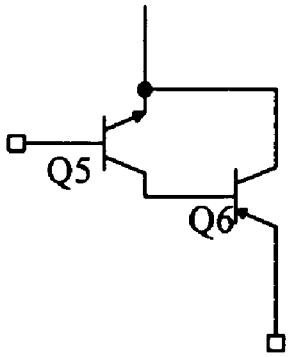

In the embodiment as shown in FIG. 4, the first regulating transistor 11 or the second regulating transistor 12 can be replaced by an NPN bipolar transistor Q5, and a PNP bipolar transistor Q6. A collector of the NPN bipolar transistor Q5 is connected to a base of the PNP bipolar transistor Q6. An emitter of the NPN bipolar transistor Q5 and a collector of the PNP bipolar transistor Q6 are connected to each other as the input terminal. A base of the NPN bipolar transistor Q5 is the controlling terminal. An emitter of the PNP bipolar transistor Q6 is the output terminal.

Figure 5:
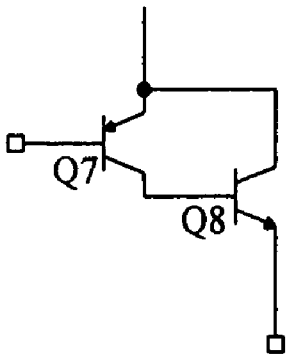

In the embodiment as shown in FIG. 5, the first regulating transistor 11 or the second regulating transistor 12 can be replaced by a PNP bipolar transistor Q7, and an NPN bipolar transistor Q8. A collector of the PNP bipolar transistor Q7 is connected to a base of the NPN bipolar transistor Q8. An emitter of the PNP bipolar transistor Q7 and a collector of the NPN bipolar transistor Q8 are connected to each other as the input terminal. A base of the PNP bipolar transistor Q7 is the controlling terminal. An emitter of the NPN bipolar transistor Q8 is the output terminal.

Figure 6:
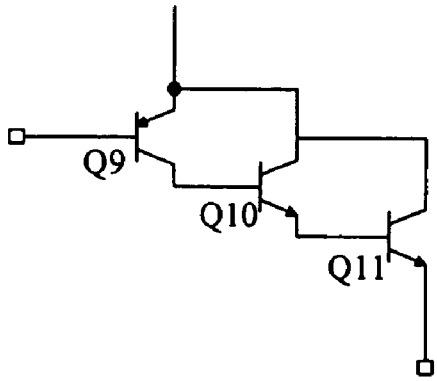

In the embodiment as shown in FIG. 6, the first regulating transistor 11 or the second regulating transistor 12 can be replaced by a PNP bipolar transistor Q9, an NPN bipolar transistor Q10, and an NPN bipolar transistor Q11. A collector of the PNP bipolar transistor Q9 is connected to a base of the NPN bipolar transistor Q10. An emitter of the NPN bipolar transistor Q10 is connected to a base of the NPN bipolar transistor Q11. An emitter of the PNP bipolar transistor Q9, a collector of the NPN bipolar transistor Q10, and a collector of the NPN bipolar transistor Q11 are connected to each other as the input terminal. A base of the PNP bipolar transistor Q9 is the controlling terminal. An emitter of the NPN bipolar transistor Q11 is the output terminal.

Figure 7:
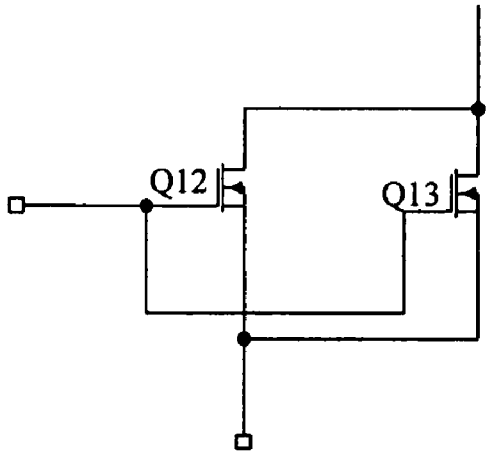
FIGS. 7–8 shows various embodiments of the pass element comprising two MOSFETs.

In the embodiment as shown in FIG. 7, the first regulating transistor 11 or the second regulating transistor 12 can be replaced by an N-channel MOSFET Q12, and an N-channel MOSFET Q13. Gates of the N-channel MOSFET Q12 and N-channel MOSFET Q13 are connected to each other as the controlling terminal. Drains of the N-channel MOSFET Q12 and N-channel MOSFET Q13 are connected to each other as the input terminal. Sources of the N-channel MOSFET Q12 and N-channel MOSFET Q13 are connected to each other as the output terminal.

Figure 8:
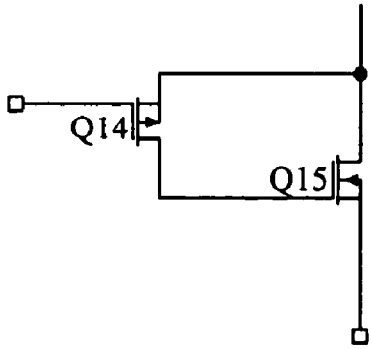

In the embodiment as shown in FIG. 8, the first regulating transistor 11 or the second regulating transistor 12 can be replaced by a P-channel MOSFET Q14, and an N-channel MOSFET Q15. A drain of the P-channel MOSFET Q14 is connected to a gate of the N-channel MOSFET Q15. A gate of the P-channel MOSFET Q14 is the controlling terminal. A source of the P-channel MOSFET Q14 and a drain of the N-channel MOSFET Q15 are connected to each other as the input terminal. A source of the N-channel MOSFET Q15 is the output terminal.

In the illustrated embodiments, the first regulating transistor pulls down the system voltage to the regulated voltage V1. An operating voltage of the second regulating transistor 12 equals to a difference of the regulated voltage V1 and the output voltage V0 (e.g. V1 minus V0). So the operating voltage is lower than a difference of the system voltage V2 and the output voltage V0 (e.g. V2 minus V0). The operating voltage of the second regulating transistor 12 is in inverse ratio to an operating current of the second regulating transistor 12 when a power of the second regulating transistor 12 is invariable. So the higher the operating voltage is, the lower the current is, when a power of the regulating transistor is invariable. Now the operating voltage is lower, therefore the linear voltage regulator can provide a higher current to the load, that is, the linear voltage regulator can provide a high-power to the load.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A linear voltage regulator comprising:

an operational amplifier receiving a regulated voltage, and a first voltage reference, and providing a driving voltage;

a first regulating transistor driven by the driving voltage, the regulating transistor receiving a system voltage, and providing the regulated voltage;

a second regulating transistor receiving the regulated voltage, and providing an output voltage, the second regulating transistor controlled by a controlling voltage;

a resistive voltage divider receiving the output voltage, and providing a second voltage reference; and a three-terminal adjustable shunt regulator receiving the second voltage reference, and providing the controlling voltage to the second regulating transistor.

2. The linear voltage regulator as claimed in claim 1, wherein the first regulating transistor comprises a controlling end receiving the driving voltage, an input end receiving the system voltage, and an output end providing the regulated voltage.

3. The linear voltage regulator as claimed in claim 1, wherein the first regulating transistor or the second regulating transistor can be replaced by two bipolar transistors, the two bipolar transistors are connected to each other.

4. The linear voltage regulator as claimed in claim 1, wherein the first regulating transistor or the second regulating transistor can be replaced by two MOSFETs (metal-oxide-semiconductor field-effect transistors), the two MOSFETs are connected to each other.

5. The linear voltage regulator as claimed in claim 1, wherein the three-terminal adjustable shunt regulator comprises a reference terminal receiving the second voltage reference, an anode terminal grounded, and a cathode terminal proving the controlling voltage, and the cathode terminal connected to a system voltage.

6. The linear voltage regulator as claimed in claim 1, wherein resistive voltage divider comprises two resistors, a node between the two resistors provides the second voltage reference.

7. A linear voltage regulator comprising:

a sub-circuit receiving a system voltage, and proving a regulated voltage;

a pass element receiving the regulated voltage, and providing an output voltage, the pass element controlled by a controlling voltage;

a resistive voltage divider receiving the output voltage, and providing a voltage reference; and a negative feedback circuit receiving the voltage reference, and providing the controlling voltage to the pass element.

8. The linear voltage regulator as claimed in claim 7, wherein the pass element comprises a controlling terminal receiving the controlling voltage, an input terminal receiving the regulated voltage, and an output terminal providing the output voltage.

9. The linear voltage regulator as claimed in claim 8, wherein the pass element is comprises one bipolar transistor.

10. The linear voltage regulator as claimed in claim 8, wherein the pass element comprises one MOSFET (metal-oxide-semiconductor field-effect transistor).

11. The linear voltage regulator as claimed in claim 7, wherein the resistive voltage divider comprises two resistors, the resistors are connected to each other in series, and a node between the resistors provides the voltage reference.

12. The linear voltage regulator as claimed in claim 7, wherein the negative feedback circuit comprises a three-terminal adjustable shunt regulator, the three-terminal adjustable shunt regulator comprises a first terminal receiving the voltage reference, an second terminal grounded, and a third terminal providing the controlling voltage to the pass element, and the third terminal coupled to a system voltage.

13. The linear voltage regulator as claimed in claim 12, wherein the third terminal is coupled to the system voltage via a current limiting resistor.

14. The linear voltage regulator as claimed in claim 7, wherein the sub-circuit comprises a regulating transistor, and an operational amplifier, the operational amplifier receives a regulated voltage, and a voltage reference, and provides a driving voltage, the regulating transistor driven by the driving voltage, and receives a system voltage, and providing the regulated voltage.

* * * * *

UNITED STATES PATENT AND TRADEMARK OFFICE

CERTIFICATE OF CORRECTION

PATENT NO. : 7,161,338 B2
APPLICATION NO. : 11/284872
DATED : January 9, 2007
INVENTOR(S) : Wu Jiang and Yun Li It is certified that error appears in the above-identified patent and that said Letters Patent is hereby corrected as shown below:

In Title Page:

Under (54) Title of Invention, and Col. 1 "LINEAR VOLTAGE REGULATOR WITH AN ADJUSTABLE SHUNT REGULATOR-SUBCIRCUIT" should read --LINEAR VOLTAGE REGULATOR--

Signed and Sealed this

Twenty-seventh Day of March, 2007

JON W. DUDAS
*Director of the United States Patent and Trademark Office*